US005802986A

United States Patent [19]

Lin

[11] Patent Number: 5,802,986

[45] Date of Patent: Sep. 8, 1998

[54] PALLET DEVICE

[75] Inventor: Tsun Jen Lin, 7F-1, 420 Sec. 1, Keelung Rd., Taipei, Taiwan

[73] Assignee: Tsun Jen Lin, Taiwan

[21] Appl. No.: 839,793

[22] Filed: Apr. 18, 1997

[51] Int. Cl.[6] ..... B65D 19/00

[52] U.S. Cl. ..... 108/57.14

[58] Field of Search ..... 108/56.3, 56.1, 108/51.1, 57.14; 211/181.1, 126.9, 126.8, 106

[56] References Cited

U.S. PATENT DOCUMENTS

| | | | |
|---|---|---|---|
| 919,494 | 4/1909 | Thoits et al. | 211/126.8 X |
| 1,559,695 | 11/1925 | Hatch | 211/181.1 X |
| 2,475,370 | 7/1949 | Bitney | 108/51.1 |
| 2,605,070 | 7/1952 | Fletcher | 108/51.1 |
| 3,538,861 | 11/1970 | Jurasek | 108/51.1 |
| 3,616,766 | 11/1971 | Weiss | 108/51.1 |
| 3,756,167 | 9/1973 | Wilson | 108/51.1 |
| 4,283,890 | 8/1981 | Takeda et al. | 108/51.1 X |

FOREIGN PATENT DOCUMENTS

| | | | |
|---|---|---|---|
| 1530386 | 6/1968 | France | 108/51.1 |
| 2811655 | 9/1979 | Germany | 108/51.1 |
| 226552 | 9/1989 | Japan | 108/51.1 |

*Primary Examiner*—Jose V. Chen

*Attorney, Agent, or Firm*—Shoemaker and Mattare, Ltd.

[57] ABSTRACT

A pallet device for supporting goods during transportation is provided. The pallet device includes a frame consisting of a plurality of lengthwise bars and a plurality of crosswise bars intercrossing the lengthwise bars. A plurality of foot members are detachably mounted at selected positions on the frame for supporting the pallet device by raising the frame to a height from the ground. The foot member includes a coupling portion for coupling each of the foot members to one of the lengthwise bars and the crosswise bars, and an upholding member connected to the coupling portion for supporting the frame on the ground. The pallet device is made from standard and widely used steel bars that allows the pallet device to have a low manufacturing cost and small dimensions. When not in use, the pallet device can be disassembled for easy storage. The foot member can be mounted in multiple at various positions on the frame so as to evenly support the weight of goods thereon.

9 Claims, 6 Drawing Sheets

PALLET DEVICE

BACKGROUND OF THE INVENTION

1. Field of the Invention

This invention relates in general to a pallet device used to support goods during transportation.

2. Description of Related Art

Nowadays, in transportation of goods such as electronic products, computer components, computer peripheral devices, and etc. from one country to another, the goods to be transported are usually stacked on and tied to a pallet on which the goods are supported, and the goods along with the pallet are placed in a shipment container for transportation. After reaching the destination, the pallet is removed from the goods and then either discarded or collected for later use. Since the cost of the pallet is also included in the overall shipment cost, it is desired that the pallet has a low manufacturing cost and small dimensions for competitive on the market.

FIG. 1 shows a conventional pallet for supporting goods during transportation which includes a plurality of parallel-spaced flat wooden pieces supported on a plurality of parallel-spaced wooden bars that are oriented at right angle with respect to the overlying flat wooden pieces. This pallet has a flat top surface for placing the goods thereon, and is raised by the underlying wooden bars to a height above the ground that allows the lifter to lift and move the pallet along with the goods supported thereon. One drawback to the wooden pallet is that it requires the use of wood to manufacture, which is an undesired factor when green protection is considered. Furthermore, many countries, including Australia and People's Republic of China, have importation laws strictly requiring that all wood-made articles be subjected to fumigation for quarantine procedures. For the exportation business, this means an increase in the shipment cost when the wooden pallet is used to support the exported goods during transportation.

Various other materials arc thus used instead of wood for the manufacture of the pallet such as metal, corrugated hard paper, or plastics. Although the fumigation treatment is not required, the manufacturing cost is higher than wood-made ones. These pallets are therefore not very cost-effective and suitable for use only at local storehouses. Considering cost the wooden pallet is consequently still in wide use. The foregoing problems therefore remain unsolved.

Furthermore, conventional pallets are usually bulky in dimensions, particularly in height. Since all shipment companies count the freight and fees based on the overall volume of the lading, the bulky wooden pallets will increase the shipment cost. In addition, the wooden pallets are also space-consuming in storage because of their bulky structure. There exists, therefore, a need for a new pallet which is small in dimensions so that shipment cost can be reduced and storage space therefor can be diminished.

SUMMARY OF THE INVENTION

It is therefore a primary objective of the present invention to provide a pallet device which includes a number of detachable foot members that can be mounted at various positions on the pallet device for evenly supporting the weight of the goods thereon.

It is another objective of the present invention to provide a pallet device which is small in dimensions so that shipment cost can be reduced.

It is still another objective of the present invention to provide a pallet device which is easy and cost-effective to manufacture.

It is yet another objective of the present invention to provide a pallet device that reduces storage space when in storage.

In accordance with the foregoing and other objectives of the present invention, an improved pallet device for supporting goods during transportation is provided. The pallet device includes a frame consisting of a plurality of lengthwise steel bars and a plurality of crosswise steel bars intercrossing the lengthwise steel bars. These steel bars are preferably multi-segment steel bars with engravings on the surface thereof. Further, a plurality of foot members are detachably mounted on selected positions on the frame for supporting the pallet device by raising the frame to a height from ground. The frame is made from hard and flexible steel bars that are standard and widely used multi-segment steels with engravings that have increased friction to allow the pallet device to support the goods thereon more stably. Other hard and flexible bars, such as aluminum bars, hollowed steel bars, or alloy bars or the like can be used instead.

The frame is a grid-like structure consisting of a plurality of lengthwise steel bars and a plurality of crosswise steel bars intercrossing the lengthwise steel bars substantially at a right angle. A plurality of enforcement steel bars can be diagonally mounted on the frame so as to enforce the strength of the frame to support weighty goods thereon. This allows the weight of the goods to be supported evenly by the enforcement steel bars.

The lengthwise steel bars and the crosswise steel bars can be joined together either by soldering, tying or by using a plurality of four-way connectors that are connected at the intersections between the lengthwise steel bars and the crosswise steel bars. Also, the lengthwise steel bars and the crosswise steel bars can be formed with a plurality of crooked portions for holding the intercrossed crosswise steel bars or lengthwise steel bars therein or for holding the foot members therewith.

In one embodiment the foot member includes a coupling portion for coupling each of the foot members to one of the lengthwise steel bars and the crosswise steel bars, and a standoff member connected to the coupling portion for supporting the frame above the ground. The coupling portion is a flexible piece formed with a recess having an opening that is small in width compared to the diameter of the lengthwise and crosswise steel bars. This allows one of the lengthwise or crosswise steel bars of the frame to be fitted in the coupling portion of the foot member so as to couple the foot member securely to one of the lengthwise or crosswise steel bars of the frame.

In another embodiment, the foot member includes a pair of coupling arms for coupling one neighboring parallel pair of the lengthwise steel bars or the crosswise steel bars, a pair of supporting detents formed in the respective arms for supporting the frame; and a standoff portion connected to the supporting portions for raising the frame to a height from the ground. The coupling arms are formed with a pair of clamping fingers for clamping one neighboring parallel pair of the lengthwise steel bars and the crosswise steel bars. Further, a base portion is connected to the standoff for resting the foot member on the ground, and a brace is connected to the base portion, diagonally abutting the standoffs to improve their strength.

The foot member can be mounted in multiple at various positions beneath the frame so that the weight of the goods can be supported evenly. This allows the pallet device of the present invention to have a reduced height but still be able to support weighty articles thereon. The pallet device allows reduced volume of the overall lading in the container so that shipment cost can be reduced.

In use, the invention has several advantages over the prior art. First, the pallet device of the invention can be assembled by using standard parts for the support of goods of various weights. When not in use, the pallet device can be easily disassembled for storage. It also allows reduced transportation cost.

Second, the pallet device of the invention is small in height but capable of supporting large weight thereon. Taking the second preferred embodiment as example, the steel bars can be the D10 steel bars in accordance with the CNS 560-A21 standard, which has a diameter of 0.953 cm. This allows the assembled pallet device to have a height of only about 5 cm. Compared to the prior art which has a height of 15 cm, the advantage of the invention over the prior art is apparent. The transportation cost for cargoes using the pallet device of the invention can thus be reduced, making the pallet device of the invention very competitive on the market.

Third, since the pallet device of the invention is made from non-wood material, it will not require the fumigation for quarantine procedures when the goods is at the custom service of another country for importation.

Fourth, the foot member can be mounted at various positions beneath the frame so that the weight of goods can be supported evenly. Fifth, the steel bars used in the pallet device of the invention are the standard and widely used types of steel bars so that manufacturing cost thereof is low. The engraving on the steel bars also allow increased friction that makes the pallet device to support the goods thereon more stably. Sixth, the manufacture of the pallet device of the invention can be carried out by automation. The manufacturing cost of the pallet device of the invention is therefore very low compared to the prior art which is made by human labors to assemble the wooden parts.

BRIEF DESCRIPTION OF DRAWINGS

The invention can be more fully understood by reading the following detailed description of the preferred embodiments, with reference made to the accompanying drawings, wherein.

DETAILED DESCRIPTION OF PREFERRED EMBODIMENT

A first preferred embodiment of the pallet device of the invention is disclosed and described in detail in the following with reference to FIGS. 2 through 4.

Figure 1:
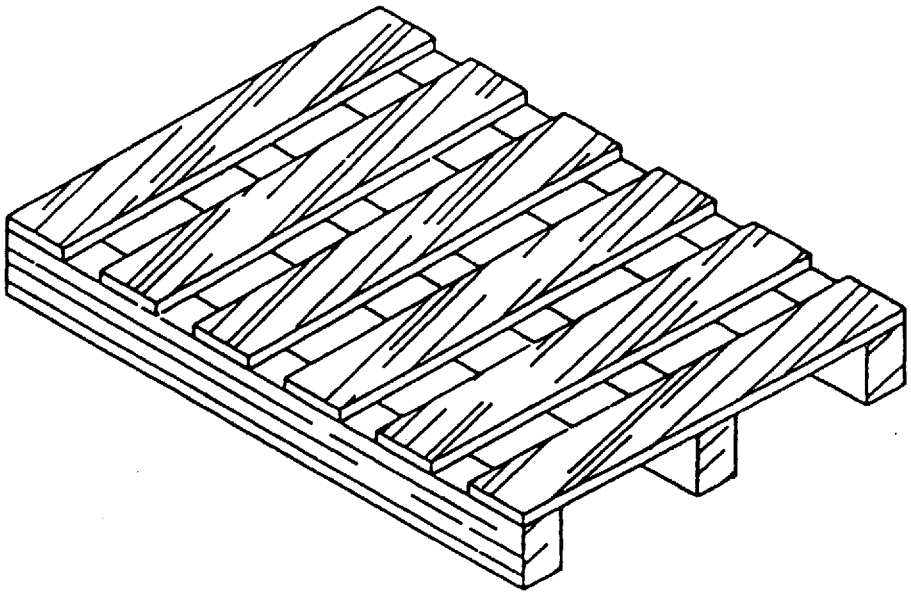
FIG. 1 (PRIOR ART)
FIG. 1 is a perspective view of a conventional pallet.
Figure 2:
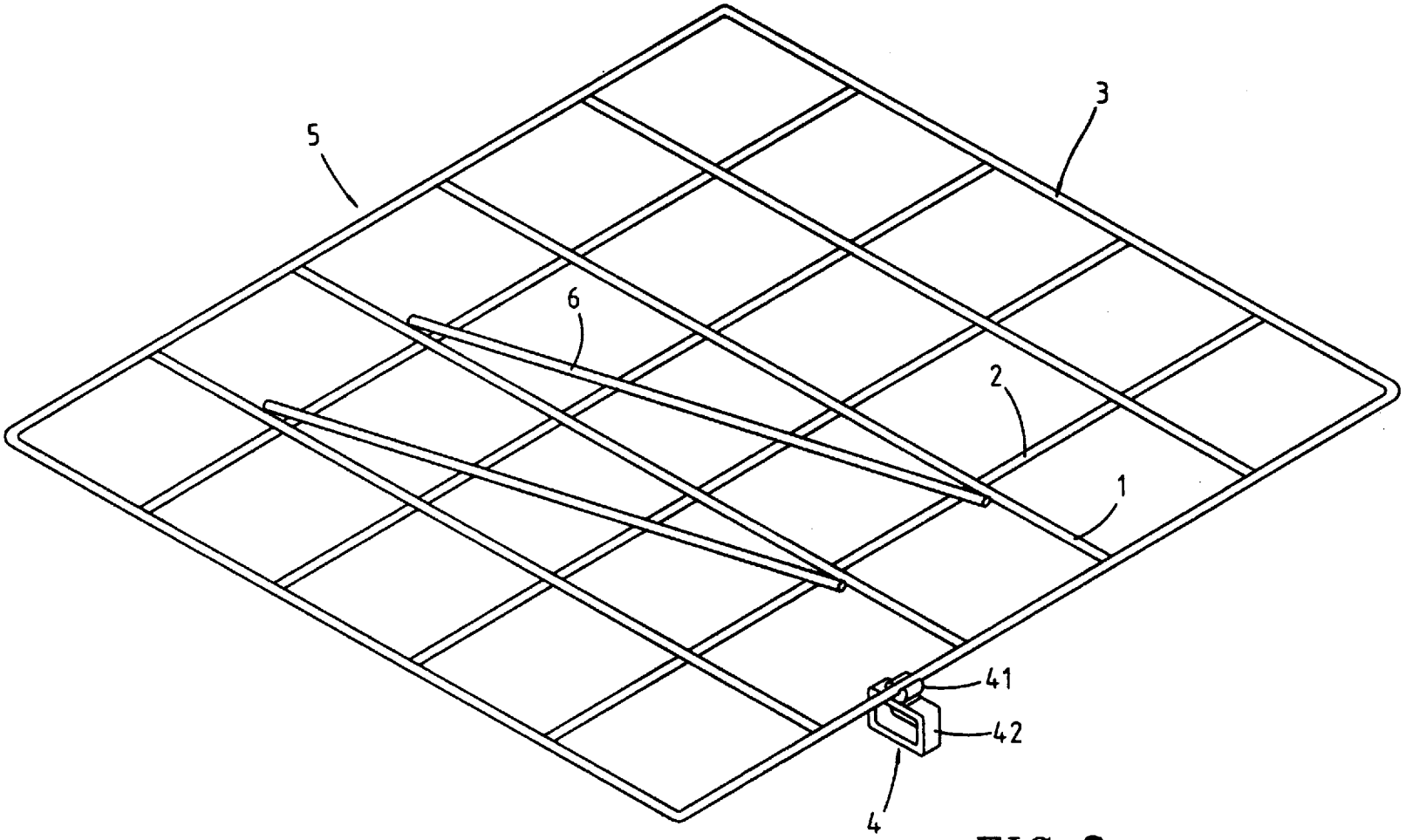
FIG. 2 is a perspective view of a first preferred embodiment of the pallet device board according to the invention.

Referring to FIG. 2, the first preferred embodiment of the pallet device of the invention, as indicated by the reference numeral 5, includes a grid-like frame 3 consisting of a plurality of lengthwise steel bars 1 and a plurality of crosswise steel bars 2. The lengthwise steel bars 1 intercross the crosswise steel bars 2 substantially at a right angle. The pallet device 5 also includes a foot member 4 coupled to one of the crosswise steel bars 2 on the frame 3. Further, the pallet device 5 includes a plurality of diagonally-linked enforcement steel bars 6 on the frame 3 for enforcement of the same. The enforcement steel bars 6 are linked diagonally between two intersections between the intercrossed lengthwise steel bars 1 and the crosswise steel bars 2 for enforcement of the same. The lengthwise steel bars 1, crosswise steel bars 2, and enforcement steel bars 6 are linked to each other by soldering or tying.

Figure 3:
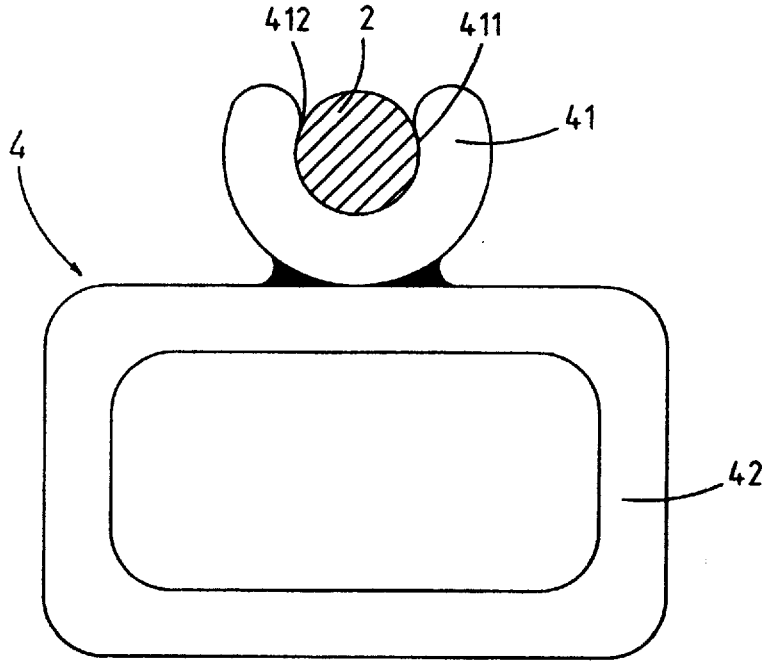
FIG. 3 is a sectional diagram showing the coupling between a foot member and a steel bar in the first preferred embodiment of the pallet device according to the invention.

As shown in FIG. 3, the foot member 4 includes a coupling portion 41 for coupling the foot member 4 to the frame 3 and standoff member 42 linked to the coupling portion 41 by soldering. The coupling portion 41 is a flexible piece formed at one end to provide a recess 411 having an opening 412 that is small in width compared to the diameter of the crosswise steel bars 2. This allows one of the crosswise steel bars 2 of the frame 3 to be fitted in the coupling portion 41 of the foot member 4 so as to couple the foot member 4 securely to one of the crosswise steel bars 2 of the frame 3.

Figure 4:
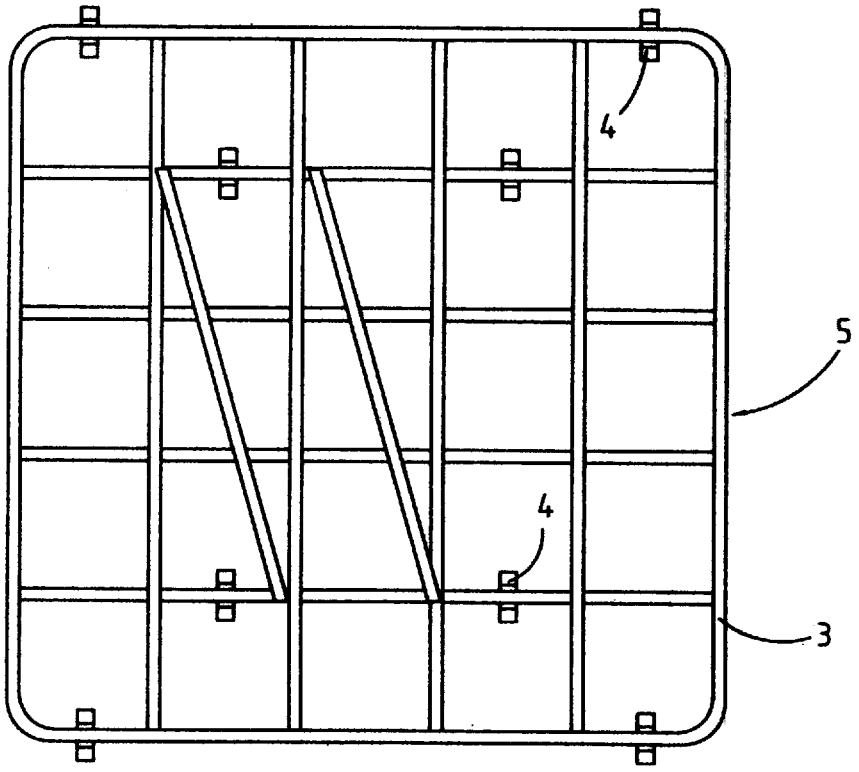
FIG. 4 is a top view of the first preferred embodiment of the pallet device according to the invention.

Referring further to FIG. 4, the foot member 4 can be attached to the frame 3 in multiple, for example eight as in the example of FIG. 4, in a manner described in the foregoing, so as to raise the frame 3 to a height from the ground. The number of the foot members 4 is dependent on the weight of goods that is to be supported by the pallet device 5. This allows the foot members 4 to support various weights thereon.

A second preferred embodiment of the pallet device of the invention is disclosed and described in detail in the following with reference to FIGS. 5 and 6.

Figure 5:
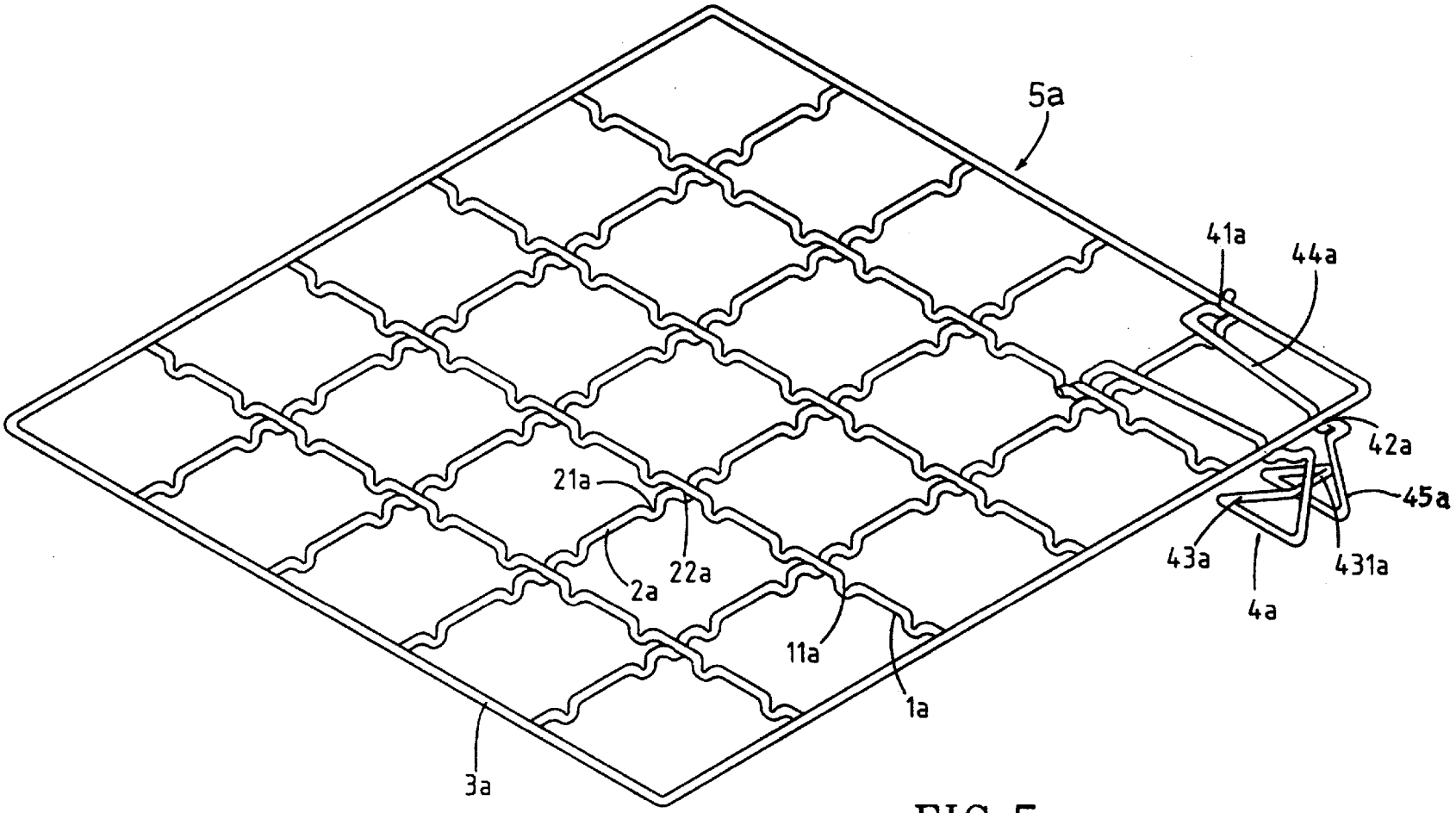
FIG. 5 is a perspective view of a second preferred embodiment of the pallet device according to the invention.

Referring to FIG. 5, the second preferred embodiment of the pallet device of the invention, as indicated by the reference numeral 5*a*, includes a grid-like frame 3*a* consisting of a plurality of lengthwise steel bars 1*a* and a plurality of crosswise steel bars 2*a*. The lengthwise steel bars 1*a* intercross the crosswise steel bars 2*a* substantially at a right angle. Further, the pallet deice 5*a* also includes a foot member 4*a* coupled to one of the crosswise steel bars 2*a* of the frame 3*a*.

In one aspect, this pallet device 5*a* differs from the previous embodiment in that the lengthwise steel bars 1*a* that are intercrossed with the crosswise steel bars 2*a* are both formed a plurality of crooked portions 11*a* spaced substantially at equal intervals along the lengthwise steel bars 1*a*; and similarly, the crosswise steel bars 2*a* are formed with a plurality of paired crooked portions 21*a*, 22*a* spaced substantially at equal intervals along the crosswise steel bars 2*a*. Each of the crooked portions 22*a* on the crosswise steel bars 2*a* is located at one intersection between the lengthwise steel bars 1*a* and the crosswise steel bars 2*a*, used to hold one straight segment of the lengthwise steel bars 1*a* therein. By contrast the two of the lengthwise steel bars 1*a* on the outermost sides and the two of the crosswise steel bars 2*a* on the outermost sides of the frame 3*a* are straight bars without the forming of crooked portions thereon. After being soldered together, the six lengthwise steel bars 1*a* and the six crosswise steel bars 2*a* in combination form the frame 3*a*.

In another aspect the pallet device 5*a* of the second preferred embodiment of the invention differs from the previous first preferred embodiment in that the foot member

4*a* is an integral segment of steel bar which is bent in such a manner as to form a pair of clamping fingers 41*a* formed at one end thereof and a pair of supporting portions 42*a* formed at the other end of the arm portion 44*a*, a base portion 43*a* connected to the supporting portions 42*a* for resting the foot member 4*a* on the ground, and a brace 431*a* formed in the base portion 43*a*. The clamping fingers 41*a* are formed on the other end of the arm portion 44*a* and angled with respect to the same. The free end of each of the clamping fingers 41*a* is formed with a detent portion that allows the clamping fingers 41*a* to be coupled to one neighboring pair of the lengthwise steel bars 1*a* or the crosswise steel bars 2*a*. The supporting portions 42*a* are each a detent which can hold one of the lengthwise steel bars 1*a* or the crosswise steel bars 2*a* therein so as to support the frame 3*a* above the ground. The base 43*a* is formed in such a manner as to be able to stably rest the whole foot member 4*a* on the ground.

The arm portions 44*a* of the foot member 4*a* can be held in two crooked portions 11*a* of the lengthwise steel bars 1*a* or two crooked portions 21*a* of the crosswise steel bars 2*a* and positioned within the enclosed space in the frame 3*a*. The insetting of the arm portion 44*a* in the crooked portions of the lengthwise steel bars 1*a* or the crosswise steel bars 2*a* allows the overall frame 3*a* to maintain a small thickness. Furthermore, the base portion 43*a* includes a brace 431*a* abutting the standoffs 45*a* so as to reinforce the foot. When packing the goods with the pallet device 5*a*, the strapping belt or rope can be wound past the brace portion 431*a* to fasten the goods tightly to the pallet device 5*a*.

Figure 6:
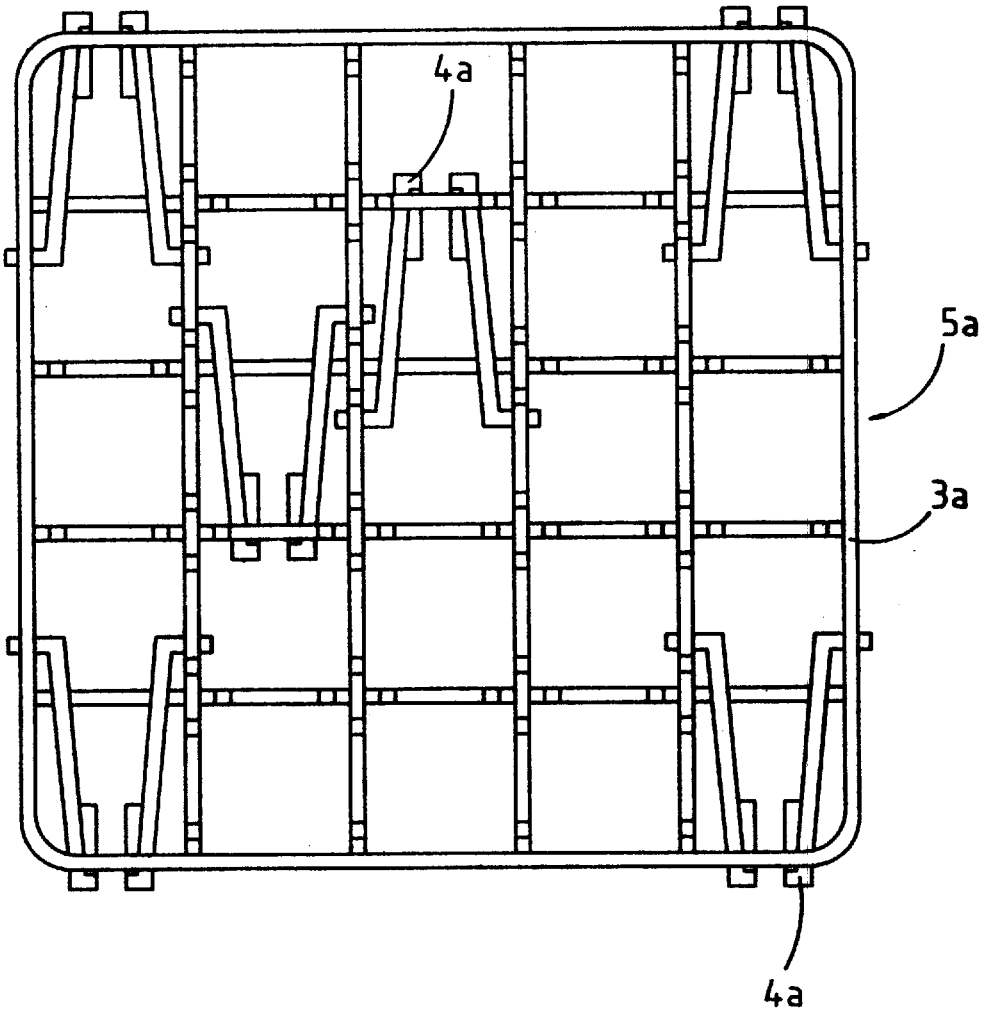
FIG. 6 is a top view of the second preferred embodiment of the pallet device according to the invention.

As shown in FIG. 6, the foot member 4*a* can be attached to the frame 3*a* in multiple, for example six as in the example of FIG. 6, in a manner described in the foregoing, so as to raise the frame 3*a* to a height from the ground. The number of the foot members 4*a* is dependent on the weight of the goods that is to be supported by the pallet device 5*a*. This allows the foot members 4*a* to support various weights thereon.

Figure 7:
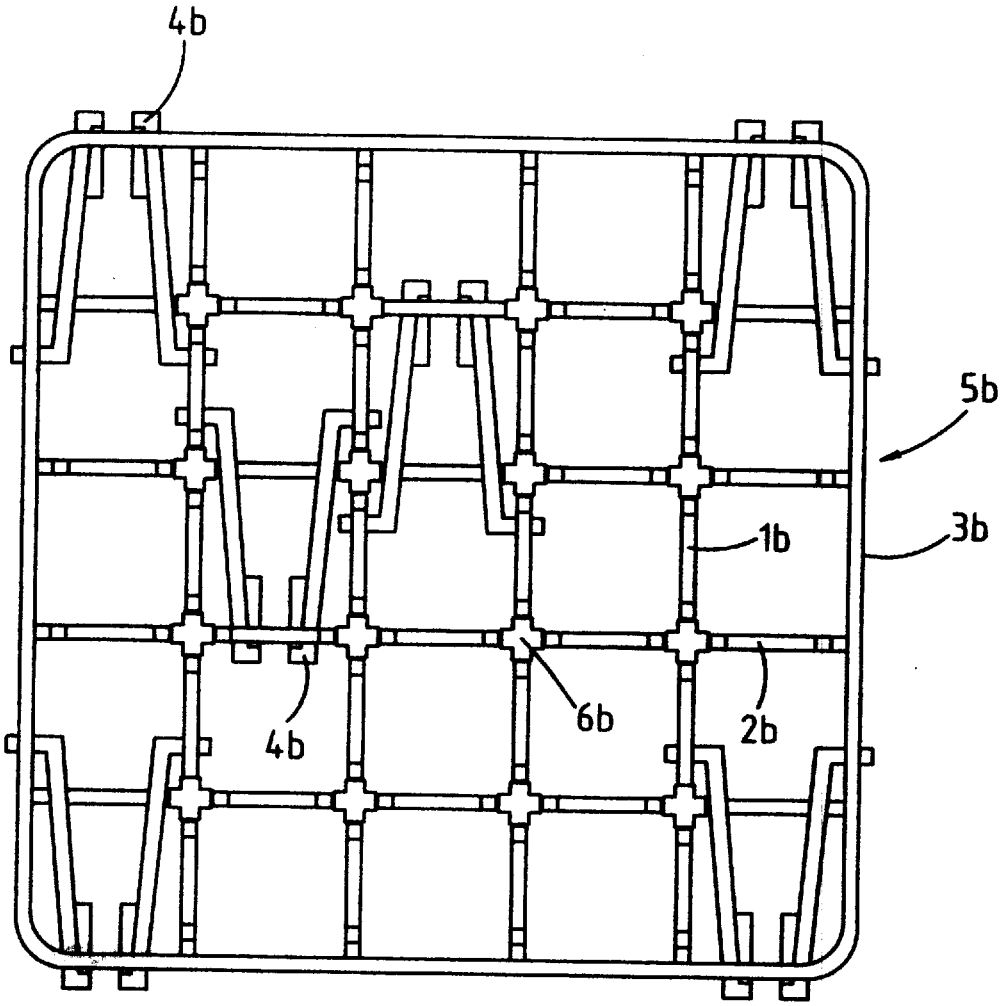
FIG. 7 top view of a third preferred embodiment of the pallet device according to the invention.

A third preferred embodiment of the pallet device of the invention is disclosed and described in detail in the following with reference to FIG. 7. As shown, the pallet device according to the third preferred embodiment of the invention, here designated by the reference numeral 5*b*, includes a grid-like frame 3*b* consisting of a plurality of lengthwise steel bars 1*b* and a plurality of crosswise steel bars 2*b*. This embodiment differs from the first preferred embodiment in that the lengthwise steel bars 1*b* and crosswise steel bars 2*b* are interconnected by means of a plurality of four-way connectors 6*b*. The foot member 4*b* here is identical in structure as that used in the previous second preferred embodiment. Similarly, the foot member 4*b* can be attached to the frame 3*b* in multiple, for example six as in the example of FIG. 7 so as to raise the frame 3*a* to a height from the ground. Other structures of the pallet device 5*b* are the same as previous preferred embodiments so the description thereof will not be further detailed.

The invention has been described using exemplary preferred embodiments. However, it is to be understood that the scope of the invention is not limited to the disclosed embodiments. To the contrary, it is intended to cover various modifications and similar arrangements. The scope of the claims, therefore, should be accorded the broadest interpretation so as to encompass all such modifications and similar arrangements.

What is claimed is:

1. A pallet device, comprising a frame consisting of a plurality of lengthwise bars and a plurality of crosswise steel bars intercrossing said lengthwise bars; and a plurality of foot members, detachable mounted at selected positions on said frame, for supporting said pallet device by raising said frame to a height from the ground, each of said foot members including a base, a pair of standoffs extending upward from one side of the base, a pair of arms extending from said standoffs generally parallel to and over the base, each arm having a support detent at one end of the arm, above the base, for engaging one of said crosswise bars or lengthwise bars and a clamping finger at a free end of the arm for engaging one of said crosswise bars or lengthwise bars.

2. The pallet device of claim 1, wherein said base comprises a brace diagonally reinforcing said standoffs.

3. The pallet device of claim 2, wherein said base portion extends from said supporting portions and includes a pair of flat portions for resting said foot member on the ground.

4. The pallet device of claim 1, wherein said lengthwise and crosswise bars arc multi-segment steel bars.

5. The pallet device of claim 1, wherein said coupling portions, said supporting portions, and said upholding portion are integrally formed by bending a steel bar.

6. The pallet device of claim 1, wherein said clamping portions are bent to a right angle with respect to said arm portions.

7. The pallet device of claim 1, wherein said supporting portions are a plurality of crooked portions formed on one side of said arm portions.

8. The pallet device of claim 1, wherein said lengthwise bars and said crosswise bars are joined together by soldering.

9. The pallet device claim 1, wherein said lengthwise bars and said crosswise bars are jointed together by a plurality of four-way connectors, each being connected at one intersection between said lengthwise bars and said crosswise bars.

* * * * *